United States Patent [19]

Müller et al.

[11] Patent Number: 4,824,039

[45] Date of Patent: Apr. 25, 1989

[54] APPARATUS FOR APPLYING A PAPER WEB TO THE UNDERSIDE OF A ROLL-MAKING DRUM

[75] Inventors: Georg Müller, Neuss; Gerhard Buschmann, Düsseldorf; Peter Hoffmann, Korschenbroich, all of Fed. Rep. of Germany

[73] Assignee: Jagenberg Aktiengesellschaft, Dusseldorf, Fed. Rep. of Germany

[21] Appl. No.: 175,897

[22] Filed: Mar. 31, 1988

[30] Foreign Application Priority Data

Mar. 31, 1987 [DE] Fed. Rep. of Germany ..... 3710143

[51] Int. Cl.[4] ..... B65H 19/28

[52] U.S. Cl. ..... 242/65; 242/671 R; 226/92

[58] Field of Search ..... 226/92, 95; 242/195, 242/74, 67.1 R, 66, 78.3, 65, 56 R

[56] References Cited

U.S. PATENT DOCUMENTS

| | | | |
|---|---|---|---|
| 2,862,705 | 12/1958 | Faber | 226/92 X |
| 2,944,345 | 7/1960 | Faeber | 226/92 X |
| 3,592,403 | 7/1971 | Schmitt | 242/65 X |
| 3,869,095 | 3/1975 | Diltz | 242/67.1 R X |
| 4,508,283 | 4/1985 | Beisswanger | 242/66 X |
| 4,601,441 | 4/1986 | Oinonen et al. | 242/56 |
| 4,732,341 | 3/1988 | Ruff | 242/66 X |
| 4,734,153 | 3/1988 | Kubo | 242/56 X |
| 4,770,359 | 9/1988 | Kiuchi | 242/56 |

FOREIGN PATENT DOCUMENTS

| | | |
|---|---|---|
| 3102894 | 5/1982 | Fed. Rep. of Germany . |
| 3117094 | 11/1982 | Fed. Rep. of Germany . |

*Primary Examiner*—Stuart S. Levy
*Assistant Examiner*—J. Eghtessad
*Attorney, Agent, or Firm*—Herbert Dubno

[57] ABSTRACT

A device for lifting the leading end of a paper web to the underside of a support drum on which rolls can be formed from the paper web comprises a lifting device which has a suction box pivotal thereon about an axis parallel to the drum axis, so that as the suction box passes between the blades of a longitudinal slitter, it can assume a generally vertical orientation. The suction surface is elastically deformable against the underside of the drum.

7 Claims, 2 Drawing Sheets

APPARATUS FOR APPLYING A PAPER WEB TO THE UNDERSIDE OF A ROLL-MAKING DRUM

CROSS REFERENCE TO RELATED APPLICATION

This application is related to our commonly assigned copending application Ser. No. 173,732 filed 25 Mar. 1988 based upon German application No. P37 10 142.9 filed 31 Mar. 1987.

FIELD OF THE INVENTION

Our present invention relates to an apparatus for the application of a leading end of a paper web to the underside of a perforated drum along which the paper web is drawn to a roll-making location at which one or more rolls can be formed from the paper web. More particularly, the invention relates to a system for displacing a paper web along a guide path beneath the roll-forming drum and for lifting that leading end and applying it to the underside of the drum.

BACKGROUND OF THE INVENTION

In roll-making machines of the type in which the roll is formed by winding a paper web on a core as the roll rests upon a drum along which the paper web is supplied to the roll in formation, i.e. in roll-making and coiling stations, it is necessary from time to time to apply a new leading end of the paper web to the underside of the drum so that by suction, the leading end of the paper web is conducted to the roll-forming station.

This need arises, for example, when a supply roll delivering the paper web to an upstream end of the web guide means must be changed and whenever there is a breakage in the web being fed to the roll-forming location or some other discontinuity in the feed of the paper web to the roll-forming station. In the past, the process of drawing the leading end of the new web to the roll-forming drum and applying the leading end to the underside of that drum has been time-consuming and labor intensive.

For the most part, the roll-forming drum in such machines is provided above a floor below which the paper guide path is provided. The introduction of a new paper web may require a service person in the below-floor spaces which are not readily accessible and generally do not permit such service personnel to stand erect, so that the leading end of the web can be manually fed upwardly through an opening in the floor to the underside of the drum and to thread the paper web through a longitudinal paper-slitting arrangement which may be provided to subdivide the web transversely into a plurality of strips each of which is to be wound in a respective roll on the drum. The blades of the longitudinal paper slitter generally can only be separated with a limited stroke and thus the operation involves rather delicate manipulation.

After the paper web is passed through the slitter, it is applied to the underside of the drum which, as previously indicated, may be perforated and under suction so that the drum can entrain the paper web, now formed into a plurality of strips, to the roll-forming locations.

A roll-making drum to which the web is supplied from below is described in German patent document DE-PS No. 31 02 894.

To facilitate the feeding of the leading end of a web to the region beneath the paper-roll-making machine drum, also referred to the herein as a support drum, it has been proposed in German patent document DE-OS No. 31 17 094 to direct the leading end of the web by compressed air with the aid of a raisable and lowerable web-feed table, against the underside of the support drum. This approach has, however, been found to be unsatisfactory.

OBJECTS OF THE INVENTION

It is the principal object of the present invention to provide an improved apparatus for applying the leading end of a paper web to the underside of a support drum in a paper-roll-making machine which avoids the drawbacks of earlier systems as described.

Another object of the invention is to provide an apparatus for lifting the leading end of a paper web, guided along a path beneath the floor of a paper-roll-making machine to the underside of a support drum thereof and applying the paper web to the underside of the support drum which eliminates the need for personnel beneath the floor, is efficient and is reliable.

SUMMARY OF THE INVENTION

These objects and others which will become apparent hereinafter are attained, in accordance with the invention in an apparatus for lifting a leading end of a paper web and applying it to the underside of a paper-roll-making machine drum which comprises:

feed means for advancing a paper web beneath a paper-roll-making machine drum so that a leading end of the web lies below the drum;

an evacuatable suction box adapted to draw by suction the paper web at the leading end against an elastically deformable suction surface of the box;

a selectively raisable and lowerable lifting device disposed below the paper-roll-making machine drum and carrying the suction box to raise the suction box from a location at which the suction box engages the web to the underside of the paper-roll-making machine drum;

means for pivotally mounting the suction box on the lifting device for swinging movement about an axis generally parallel to an axis of the paper-roll-making machine drum, whereby the surface can assume an approximately vertical orientation as the paper web is lifted to the underside of the paper-roll-making machine drum; and means for elastically biasing the suction box into a position in which the suction surface is generally vertical, the suction box being swingable upon approach to the underside of the paper-roll-making machine drum to press a leading end of the web with surface contact against the underside of the drum, the suction surface being elastically deformable by the paper-roll-making machine drum as the suction box is pressed thereagainst.

The invention, therefore, resides in the provision below a roll-making machine drum of an evacuatable member, referred to herein as a suction box, which is swingably mounted on a raisable and lowerable lifting device, preferably a fluid-operated jack, i.e. a piston-and-cylinder arrangement or an elector-motor-driven telescoping arrangement so that the suction box can swing about an axis parallel to the drum axis to bring an elastically deformable suction surface to the suction box, engageable with the paper web, into a vertical position as the paper web is led by the suction box as it is lifted, between the blade elements of the slitting device. The suction box is biased against the underside of the drum which then can elastically deform its surface to ensure a reliable transfer of the leading end of the web to the underside of the drum.

The elastic bias is preferably provided to the suction box by a spring element, advantageously a torsion spring, which swings the suction box into a vertical orientation as described, the spring element being stressed as the suction box is pressed against the underside of the drum.

The suction side or surface of the suction box can be perforated or otherwise formed with openings to permit suction to be applied to the paper web which is held against this surface. The surface can be formed as a freely-movable endless belt which can be elastically deformed inwardly by being pressed against the underside of the drum.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
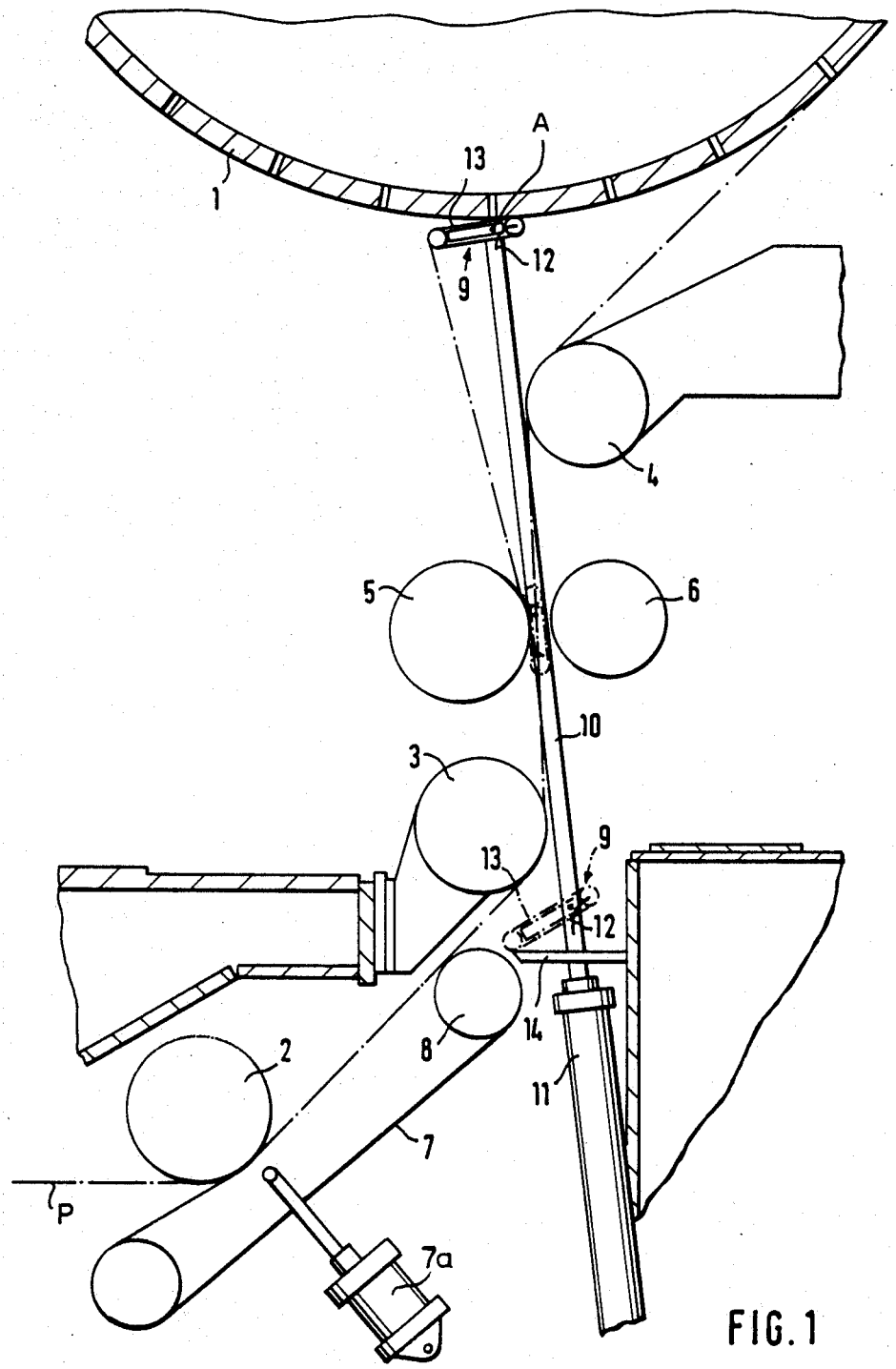
FIG. 1 is a vertical cross sectional view through the apparatus illustrating the suction box and the lifting means in accordance with the invention.

FIG. 1 shows a portion of a roll-making machine, in accordance with the invention, which comprises an evacuatable support drum 1 rotatable about an axis (not shown) which is perpendicular to the plane of the paper in this Figure and along a top of which, one or more stations can be provided to support rolls on which the paper web is wound as described in the aforementioned copending application or German patent No. 31 02 894.

Beneath the support drum 1, guide rollers 2, 3 and 4 for the paper web are provided, the guide roller 2 being located beneath the floor, the guide roller 3 being located generally in an opening in the floor through which the paper web is fed, and the guide roller 4 located above the pair of blade drums 5 and 6 which can be spread apart as illustrated and serve as longitudinal slitters for slitting the web into a plurality of strips.

The upper-blade assembly 6 in this embodiment is shown to swing away from the lower blade member 5 to clear the device for passing the paper web upwardly to the underside of the drum as will be described.

To feed the leading end of the web into the region in which the web is to be directed vertically upward, a rocker conveyor belt 7 is provided which is swingable by a fluid cylinder 7*a* and has an outlet roller 8 which, when the rocker conveyor 7 is swung into place, directs the leading end of the paper web P upwardly toward the underside of the roller 3. The roller 8 lies at a predetermined distance upstream of this roller 3 to ensure that the free end of the web will pass beneath the guide roller 3.

To this extent we have described structure which is already known.

According to the invention, in the direction of web displacement, beyond the outlet-deflecting roller 8 rocker belt 7, a flat suction box 9 can be positioned so that the free end of the web passes onto the upper surface 13 of this suction box.

The suction box 9 is swingably mounted by a shaft 20 on the ends of piston rods 10 which are disposed adjacent to narrow long sides of the suction box. The piston rods 10 are displaceable up and down, i.e. can be raised and lowered by electric motor-driven piston-and-cylinder units 11 (FIG. 1). The pivotal mounting of the suction box 9 permits the latter to swing about an axis A (FIG. 1) which is parallel to the axis of the drum 1.

The suction box 9 is located generally centrally beneath the support drum 1. Its width, parallel to the support-roll axis, amounts to approximately 10% of the working width of the roll-forming machine, in the usual case about 50 to 60 cm.

The suction box 9 can be raised and lowered between the blades 5 and 6 of the longitudinal slitter of the machine substantially from the rocker conveyor 7 to the support drum 1 and vice-versa. When the suction box 9 is oriented substantially vertically as shown in dot-dash lines in FIG. 1 where the suction box is located between the blades 5 and 6.

Figure 2:
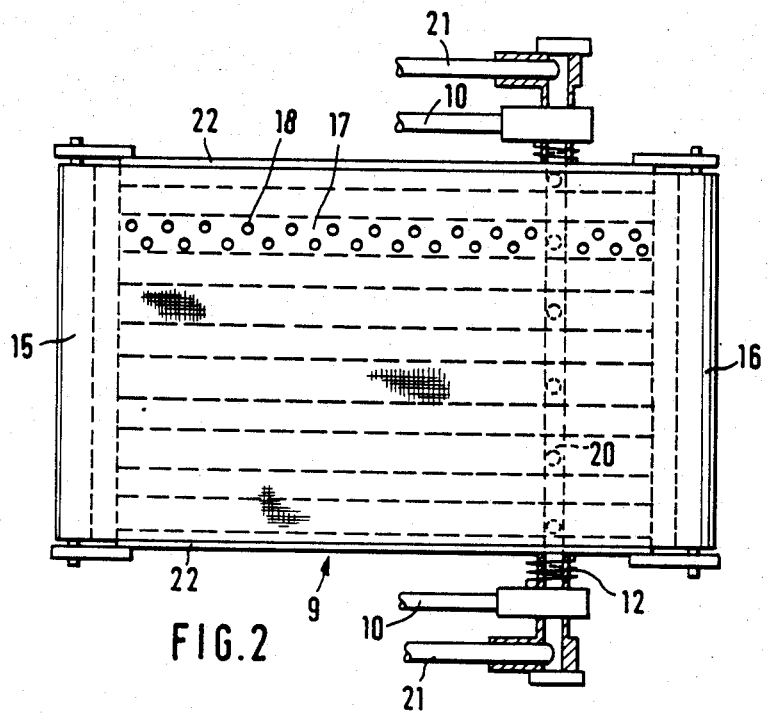
FIG. 2 is a plan view of the suction box of FIG. 1, showing other parts in section and greatly enlarged in scale with respect to FIG. 1.

A torsion spring 12 which has been schematically illustrated as a leaf spring in FIG. 1 but for practical purposes is usually a coil spring as shown in FIG. 2, biases the suction box 9 into an orientation in which the suction side 13 of the suction box lies generally parallel to the piston rod 10, i.e. generally vertically.

When the suction box is in its lower position, it is swung out, away from the piston rod 10 against the spring force by an abutment 14 so that the suction box lies approximately flush with the rocker belt 7.

Figure 3:
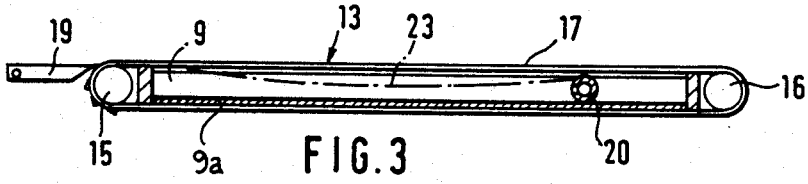
FIG. 3 is a longitudinal section through the suction box of FIG. 2.

Referring now to FIGS. 2 and 3, it can be seen that the suction box 9 is of relatively low height, i.e. has a thickness which is less than the spacing between the blades 5 and 6 in the separated positions of the blades, i.e. when the blade 6 is swung away from the blade 5. The surface 13 is perforated with holes 18 and these holes may be formed in an elastic fabric or web 17 which forms a free-running belt passing over rollers 15 and 16 supported for free rotation in a frame which can have longitudinal bars 22 on opposite sides thereof.

The belt 17 can be tensioned between the rollers 15 and 16 and can be elastic, being composed of glass fiber reinforced polytetrafluoroethylene.

On the suction side 13, the belt can be displaced in the direction of movement of the drum 1, reverse displacement being prevented by a pawl-and-ratchet mechanism shown diagrammatically at 19 in FIG. 3.

The suction box is swingable about the axis formed by the suction pipe 20 which extends into the interior of the suction box and has openings communicating with the space between the belts and connected to a vacuum source. The ends of the pipe 20 are mounted in the ends of the piston rods 10 and suction lines 21 provided with flexible pipes can be provided to evacuate the suction box. The ends of the suction box 9 can be sealed against the belt 17 by the synthetic resin bars 22 of the frame.

The opposite sides of the suction box from the surface 13 can be closed by a plate 9*a*.

In another embodiment of the suction box, the surface of the section box which is adapted to confront the drum 1 and is provided with the openings against which the paper web is held, can be nonmovable in the form of a low-friction plate, e.g. coated with polytetrafluoroethylene, which can be deformed by pressing of the suction box against the drum.

The device of FIGS. 1–3 operates as follows: a free end of the paper web, which can be pointed or folded to limit its width (see the aforementioned copending application) is fed via the rocker conveyor 7 onto the suction side 13 of the suction box 9 when the latter is in its lower position and substantially flush with the rocker conveyor 7. As the free end of the paper web passes onto the suction box 9, a light current or other sensor can be triggered to evacuate the suction box and initiate the lifting movement of the piston-and-cylinder unit 11. The lifting speed is coordinated with the feed speed.

During the lifting movement, the torsion spring swings the suction box into a position in which the suction side 13 is substantially vertical or at least parallel to the rods 10 so that the suction box with the paper web drawn thereagainst can pass readily between the blades 5 and 6 which have previously been swung apart.

When the upper end of the suction box 9 contacts the underside of the drum 1, it is swung about its axis A in the clockwise sense (FIG. 1) since the axis A is located between the ends of the suction box into a generally horizontal orientation of the suction box. The fabric 17 is thereby deformed to the curved contour of the surface of the drum 1, e.g. as represented by the broken line 23, pressing the tip of the paper web into surface contact with the support drum 1.

Simultaneously, e.g. by a limit switch on the rods 10, the suction application to the suction box 9 and the lifting stroke are terminated so that the leading end of the paper web is entrained by the drum and carried to the roll-making stations. The transfer of the paper web is effected without crushing of the paper web since the free-running belt 17 can be entrained with the drum 1 while it holds the paper web in contact therewith. Of course, the suction box 9 can then be lowered and the blades 5 and 6 closed to permit slitting of the web, the torsion springs 12 serving to orient the suction box vertically as the suction box passes between the blades 5 and 6 before they are closed. When the suction box 9 reaches its lower position, it is again swung out by the abutment 14.

We claim:

1. An apparatus for lifting a leading end of a paper web and applying it to the underside of a paper-roll-making machine drum, comprising:

feed means for advancing a paper web beneath a paper-roll-making machine drum so that a leading end of said web lies below said drum;

an evacuatable suction box adapted to draw by suction said paper web at said leading end against an elastically deformable suction surface of said box;

a selectively raisable and lowerable lifting device disposed below said paper-roll-making machine drum and carrying said suction box to raise said suction box from a location at which said suction box engages said web to the underside of said paper-roll-making machine drum;

means for pivotally mounting said suction box on said lifting device for swinging movement about an axis generally parallel to an axis of said paper-roll-making machine drum, whereby said surface can assume an approximately vertical orientation as said paper web is lifted to the underside of said paper-roll-making machine drum; and means for elastically biasing said suction box into a position in which said suction surface is generally vertical, said suction box being swingable upon approach to the underside of said paper-roll-making machine drum to press a leading end of said web with surface contact against said underside of said drum, said suction surface being elastically deformable by said paper-roll-making machine drum as said suction box is pressed thereagainst.

2. The apparatus defined in claim 1 wherein said means for elastically biasing said suction box into said approximately vertical orientation of said surface is a spring element acting upon said suction box.

3. The apparatus defined in claim 1 wherein said lifting device includes a piston-cylinder unit.

4. The apparatus defined in claim 3 wherein said piston-cylinder unit is electric-motor driven.

5. The apparatus defined in claim 3 wherein said piston-cylinder unit is pneumatically driven.

6. The apparatus defined in claim 3 wherein said piston-cylinder unit is hydraulically driven.

7. The apparatus defined in claim 1 wherein said surface is a perforated belt free-running on said suction box.

* * * * *